US012296214B2

(12) United States Patent
Lagree et al.

(10) Patent No.: US 12,296,214 B2
(45) Date of Patent: May 13, 2025

(54) SHROUDED EXERCISE SPRING ASSEMBLIES

(71) Applicant: Lagree Technologies, Inc., Chatsworth, CA (US)

(72) Inventors: Sebastien Anthony Louis Lagree, Chatsworth, CA (US); Max E. Wunderlich, Los Angeles, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 251 days.

(21) Appl. No.: 18/189,426

(22) Filed: Mar. 24, 2023

(65) Prior Publication Data

US 2024/0316384 A1 Sep. 26, 2024

(51) Int. Cl.
*A63B 21/02* (2006.01)

(52) U.S. Cl.
CPC ..... *A63B 21/023* (2013.01)

(58) Field of Classification Search
CPC .... A63B 7/00; A63B 7/02; A63B 7/04; A63B 21/00043; A63B 21/00178; A63B 21/002; A63B 21/0023; A63B 21/023; A63B 21/025; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/16; A63B 21/1618; A63B 21/1681; A63B 21/169; A63B 21/4034; A63B 21/4035; A63B 71/0054; A63B 2071/0063; A63B 2071/0072; A63B 2071/009; A63B 2209/00; A63B 2209/02; A63B 2209/14
See application file for complete search history.

(56) References Cited

U.S. PATENT DOCUMENTS 743,204 A * 11/1903 Terry ..... A63B 21/00043 267/74
1,621,477 A 3/1927 Pilates
3,770,267 A 11/1973 McCarthy
3,869,120 A * 3/1975 Nissen ..... A63B 5/11 5/254
3,938,792 A * 2/1976 Nissen ..... A63B 5/11 267/74
4,759,540 A 7/1988 Yu
(Continued)

FOREIGN PATENT DOCUMENTS

DE 202018105995 U1 * 1/2019 ..... A63B 21/00043
KR 20130049488 A * 5/2013 ..... A63B 21/055
(Continued)

*Primary Examiner* — Gary D Urbiel Goldner
(74) *Attorney, Agent, or Firm* — Neustel Law Offices

(57) ABSTRACT

A shrouded spring assembly comprises a coil spring and a shroud. The coil spring includes a cylindrical body having first and second attachment members coupled to ends thereof. The shroud includes a sleeve portion that substantially encapsulates the cylindrical body of the coil spring, the sleeve portion including first and second end portions configured to enable the first and second attachment members to be operatively couplable to one or more external devices. The sleeve portion of the shroud is expandable and retractable along a longitudinal axis of the coil spring to accommodate stretching and retracting of the cylindrical body along the longitudinal axis.

15 Claims, 5 Drawing Sheets

(56) References Cited

U.S. PATENT DOCUMENTS 4,798,378 A 1/1989 Jones
5,022,648 A * 6/1991 Travis ..... A63B 21/00043 482/148
5,066,005 A 11/1991 Luecke
5,263,913 A 11/1993 Boren
5,318,495 A * 6/1994 Malynowsky ..... A63B 22/00 482/129
5,399,139 A * 3/1995 Malynowsky ..... A63B 21/4015 248/188.7
D362,700 S 9/1995 Breibart
D382,319 S 8/1997 Gerschefske
5,681,249 A 10/1997 Endelman
5,885,197 A 3/1999 Barton
5,904,640 A * 5/1999 Shahinian ..... A63B 21/0004 482/110
5,967,955 A 10/1999 Westfall
6,022,302 A * 2/2000 McBride ..... A63B 21/00043 482/121
6,168,496 B1 * 1/2001 Thomas ..... A63H 3/04 112/63
6,179,753 B1 1/2001 Barker
6,220,994 B1 * 4/2001 Rich ..... A63B 23/03508 482/130
6,248,047 B1 * 6/2001 Abdo ..... A63B 21/023 482/121
7,163,500 B2 1/2007 Endelman
7,803,095 B1 9/2010 Lagree
7,931,570 B2 4/2011 Hoffman
8,249,714 B1 8/2012 Hartman
8,585,554 B2 11/2013 Shavit
8,641,585 B2 2/2014 Lagree
9,050,482 B1 * 6/2015 VanElverdinghe ..... A63B 5/11
9,283,422 B2 3/2016 Lagree
9,579,555 B2 2/2017 Lagree
9,744,395 B1 8/2017 Lagree
9,868,019 B2 1/2018 Lagree
10,046,193 B1 8/2018 Aronson
10,232,212 B1 * 3/2019 Cohen ..... A63B 21/0552
10,780,307 B2 9/2020 Lagree
11,117,019 B1 9/2021 Lagree
11,452,904 B1 9/2022 Lagree
11,920,296 B1 * 3/2024 Truesdell ..... D07B 1/162
2001/0056011 A1 12/2001 Endelman
2003/0119635 A1 6/2003 Arbuckle
2005/0130810 A1 6/2005 Sands
2005/0164856 A1 7/2005 Parmater
2006/0046914 A1 3/2006 Endelman
2006/0199712 A1 9/2006 Barnard
2006/0247101 A1 * 11/2006 Hall ..... A63B 5/11 482/27
2007/0087921 A1 4/2007 Graham
2008/0070765 A1 3/2008 Brown
2008/0248935 A1 10/2008 Solow
2010/0227748 A1 9/2010 Campanaro
2011/0009249 A1 1/2011 Campanaro
2011/0143898 A1 6/2011 Trees
2011/0166002 A1 7/2011 Savsek
2011/0172069 A1 7/2011 Gerschefske
2011/0287908 A1 * 11/2011 Ahn ..... A63B 21/023 482/121
2012/0295771 A1 11/2012 Lagree
2013/0017935 A1 1/2013 Endelman
2013/0196835 A1 8/2013 Solow
2014/0011645 A1 1/2014 Johnson
2014/0100089 A1 4/2014 Kermath
2014/0121076 A1 5/2014 Lagree
2014/0141948 A1 5/2014 Aronson
2015/0080186 A1 * 3/2015 Carlin ..... A63B 5/11 482/27
2015/0246263 A1 9/2015 Campanaro
2015/0360113 A1 12/2015 Lagree
2016/0059060 A1 3/2016 Lagree
2017/0246491 A1 8/2017 Lagree
2019/0160320 A1 5/2019 Lagree
2020/0222741 A1 7/2020 Aronson
2022/0379153 A1 12/2022 Lagree
2023/0020008 A1 1/2023 Lagree
2023/0173320 A1 * 6/2023 Yee ..... A63B 21/022 482/126

FOREIGN PATENT DOCUMENTS

WO WO-9108025 A1 * 6/1991 ..... A63B 21/02
WO 2004096376 A1 11/2004

* cited by examiner

SHROUDED EXERCISE SPRING ASSEMBLIES

CROSS REFERENCE TO RELATED APPLICATIONS

Not applicable to this application.

STATEMENT REGARDING FEDERALLY SPONSORED RESEARCH OR DEVELOPMENT

Not applicable to this application.

FIELD OF THE INVENTION

The described example embodiments in general relate to shrouded spring assemblies for use in exercising, and for use in exercise apparatus and exercise machines.

BACKGROUND

To maintain or improve physical fitness, many people perform exercises by lifting weighted devices, such as dumbbells, kettlebells, or other similar devices. Using such a weighted device, a user may perform exercises by raising or moving the weighted device, working against gravitational forces using desired muscles or portions of the body to achieve the desired effect. It will be appreciated, however, that such devices may not be easily transportable to other locations, and may generally limit the user's ability to perform exercises wherever they desire to do so (e.g. at the office, hotel room, etc.). Therefore, although desirable results have been achieved using such prior art weighted devices, there is room for improvement.

SUMMARY

Some of the various embodiments of the present disclosure relate to shrouded spring assemblies for use in exercising, and for use in exercise apparatus and exercise machines.

For example, some of the various embodiments of the present disclosure include a shrouded spring assembly comprising a coil spring and a shroud. The coil spring includes a cylindrical body having a first attachment member (e.g. hook member) coupled to a first end of the cylindrical body, and a second attachment member (e.g. eye member) coupled to a second end of the cylindrical body. The shroud may include a sleeve portion that substantially encapsulates the cylindrical body of the coil spring, the sleeve portion including first and second end portions proximate the first and second attachment members, respectively. Each of the first and second end portions are configured to enable the first and second attachment members to be operatively couplable to one or more external devices. It will be appreciated that the sleeve portion of the shroud is expandable and retractable to accommodate stretching and retracting of the cylindrical body responsive to opposing forces applied to the first and second attachment members along a longitudinal axis of the 16 cylindrical body.

In some embodiments, the sleeve portion is made from a suitably flexible or stretchable material that enables the sleeve portion to expand in a lengthwise direction along the longitudinal axis as the coil spring is stretched by an exercising force, and then to contract again as the exercising force is relieved. And in some embodiments, the sleeve portion includes a plurality of pleats that enables the sleeve portion to expand and contract in a lengthwise direction along the longitudinal axis with the expansion and contraction of the cylindrical body of the coil spring.

In further embodiments, an exercise apparatus may comprise a shrouded spring assembly operatively coupled to at least one user interface. In some embodiments, the shrouded spring assembly includes: a coil spring having a cylindrical body that extends along a longitudinal axis, the coil spring including a first attachment member coupled to a first end of the cylindrical body and projecting outwardly from the first end at least partially along the longitudinal axis, and a second attachment member coupled to a second end of the cylindrical body opposite the first end and projecting outwardly from the second end at least partially along the longitudinal axis; and a shroud having a sleeve portion that encapsulates at least the cylindrical body of the coil spring, the sleeve portion including first and second end portions proximate the first and second attachment members, respectively, at least one of the first and second end portions being configured to enable a corresponding at least one of the first and second attachment members to be operatively coupled to a corresponding at least one user interface, the sleeve portion being expandable and retractable along the longitudinal axis to accommodate stretching and retracting of the cylindrical body responsive to at least one exercising force applied to at least one of the first and second attachment members along the longitudinal axis; and at least one user interface operatively coupled to at least one of the first and second attachment members, the at least one user interface configured to engage with a user for applying the at least one exercising force to the at least one of the first and second attachment members along the longitudinal axis.

And in still other embodiments, an exercise machine includes: a support frame having a fixed portion and at least one rail; a slidable member slidably coupled to the at least one rail; and at least one shrouded spring assembly coupled between the fixed portion of the support frame and the slidable member. In some embodiments, the at least one shrouded spring assembly includes: a coil spring having a cylindrical body including a first attachment member coupled to a first end of the cylindrical body and projecting outwardly from the first end, and a second attachment member coupled to a second end of the cylindrical body opposite the first end and projecting outwardly from the second end; and a shroud having a sleeve portion that substantially encapsulates the cylindrical body of the coil spring, the sleeve portion including first and second end portions proximate the first and second attachment members, respectively, each of the first and second end portions being configured to enable the first and second attachment members to be operatively couplable to one or more external devices, the sleeve portion being expandable and retractable along a longitudinal axis of the coil spring to accommodate stretching and retracting of the cylindrical body responsive to opposing forces applied to the first and second attachment members along the longitudinal axis as the slidable member is moved on the at least one rail.

There has thus been outlined, rather broadly, some of the embodiments of the present disclosure in order that the detailed description thereof may be better understood, and in order that the present contribution to the art may be better appreciated. There are additional embodiments that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Some of the various embodiments of the present disclosure relate to shrouded spring assemblies for use in exercising, and for use in exercise machines. Embodiments in accordance with the present disclosure may be easily transportable to other locations, and may advantageously enable a user's ability to perform exercises wherever they desire to do so in a safe and convenient manner.

In some example embodiments, a shrouded spring assembly comprises a coil spring, and a shroud that substantially encapsulates the coil spring. The shroud is expandable and retractable to accommodate stretching and retracting of the coil spring along its longitudinal axis. In some embodiments, a first attachment member is coupled to a first end of the coil spring and a second attachment member is coupled to a second end of the coil spring. In use, a user may secure one end of the shrouded spring assembly to a fixed object (e.g. a wall, door, heavy furniture, etc.), and a handle to other end of the shrouded spring assembly, and may then apply an exercising force to the handle. The coil spring is stretchable along the longitudinal axis responsive to the exercising force applied along the longitudinal axis, and retractable to a resting length in response to removal of the exercising force. The shrouded spring assembly is easily transportable to any desired location, and the shroud prevents foreign objects from becoming pinched or caught in the coil spring as it expands and contracts.

Various embodiments of shrouded spring assemblies, and exercise apparatus and exercise machines that include such shrouded spring assemblies, are described herein. Many specific details of certain embodiments are set forth in the following description and in FIGS. 1-9 to provide a thorough understanding of such embodiments. One skilled in the art will understand, however, that the invention may have additional embodiments, or that alternate embodiments may be practiced without several of the details described in the following description.

B. Shrouded Spring Assemblies

Figure 1:
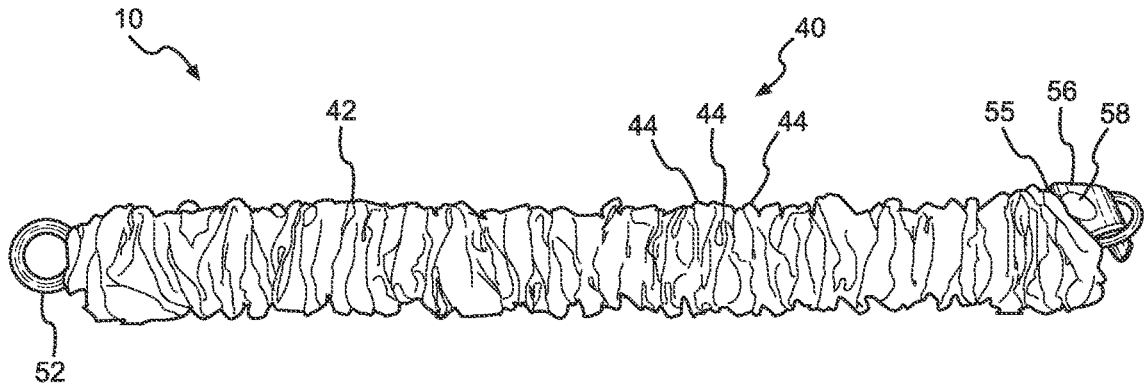
FIG. 1 is an elevational view of a shrouded spring assembly in accordance with an example embodiment.
Figure 2:
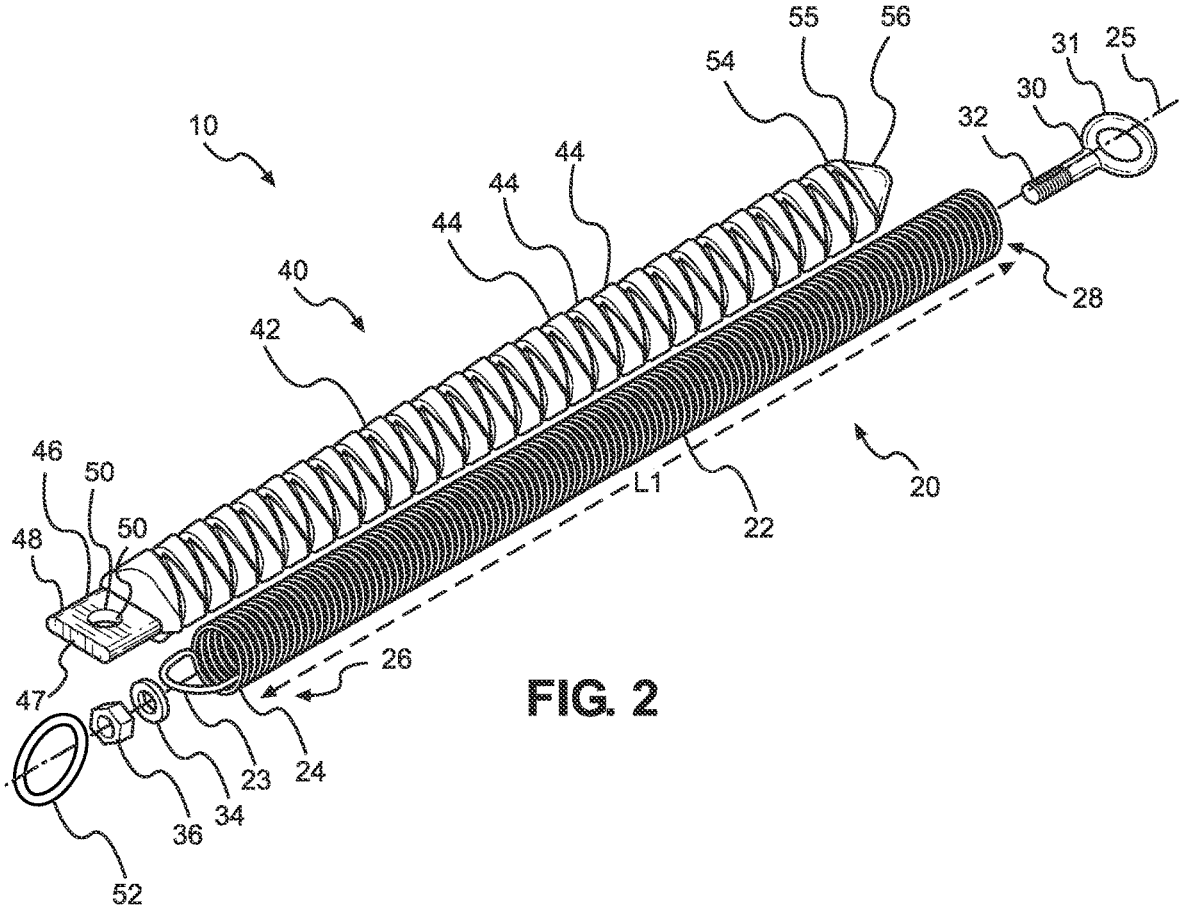
FIG. 2 is a partially exploded, perspective view of the shrouded spring assembly of FIG. 1 in accordance with an example embodiment.

3 FIG. 1 is an elevational view of a shrouded spring assembly 10 in accordance with an example embodiment. FIG. 2 is a partially exploded, perspective view of the shrouded spring assembly 10 of FIG. 1. In the embodiment shown in FIGS. 1-2, the shrouded spring assembly 10 includes a coil spring 20 having a cylindrical body 22 that extends along a longitudinal axis 25. The cylindrical body 22 has a first end 26 and a second end opposite from the first end 26. In some embodiments, the coil spring 20 includes a first attachment member 24 coupled to the first end 26 of the cylindrical body 22, and a second attachment member 30 coupled to the second end 28 of the cylindrical body 22.

The shrouded spring assembly 10 further includes a shroud 40 having a sleeve portion 42 that encapsulates the cylindrical body 22 of the coil spring 20. It will be appreciated that, in some embodiments, the sleeve portion 42 is configured to expand in a lengthwise direction along the longitudinal axis 25 as the coil spring 20 is stretched by an exercising force, and further configured to contract again as the exercising force is relieved and the coil spring 20 returns to its relaxed length L1 (FIG. 2), as described more fully below.

C. Coil Spring

As noted above, the shrouded spring assembly 10 includes a coil spring 20 that includes a cylindrical body 22 that extends along a longitudinal axis 25 having a first end and a second end 28 opposite from the first end 26. The cylindrical body 22 of the coil spring 20 extends along a longitudinal axis 25. As shown in FIGS. 1-2, in some embodiments, the coil spring 20 includes a first attachment member 24 coupled to the first end 26 of the cylindrical body 22, and a second attachment member 30 coupled to the second end 28 of the cylindrical body 22.

In use, the cylindrical body 22 of the coil spring 20 is stretchable and retractable along the longitudinal axis 25 responsive to opposing forces applied to the first and second attachment members 24, 30 along the longitudinal axis 25. For example, with the first attachment member 24 coupled to a fixed structure (e.g. a door), and the second attachment member 30 coupled to a user interface (e.g. a handle, ankle strap, etc.), the user may apply an exercise force along the longitudinal axis, stretching the coil spring 20 to a stretched length L2, and then may release the exercise force, allowing the coil spring 20 to return to the relaxed length L1.

It will be appreciated that the first and second attachment members 24, 30 may be configured in a variety of suitable ways. For example, in some embodiments, the first attachment member 24 may be configured as a hook member 23 that is coupled to the first end 26 of the cylindrical body 22, wherein the hook member 23 projects outwardly from the first end 26 at least partially along the longitudinal axis 25. The hook member 23 may be a partially oval or partially circular member (e.g. semi-circular) that is configured to be coupled to an external device or structure. For example, in some embodiments, the hook member 23 may simply be a portion of the wire that forms the coil spring 20 bent at an angle (e.g. 90 degree angle) with respect to the first end 26 so that it projects at least partially along the longitudinal axis 25.

Figure 3:
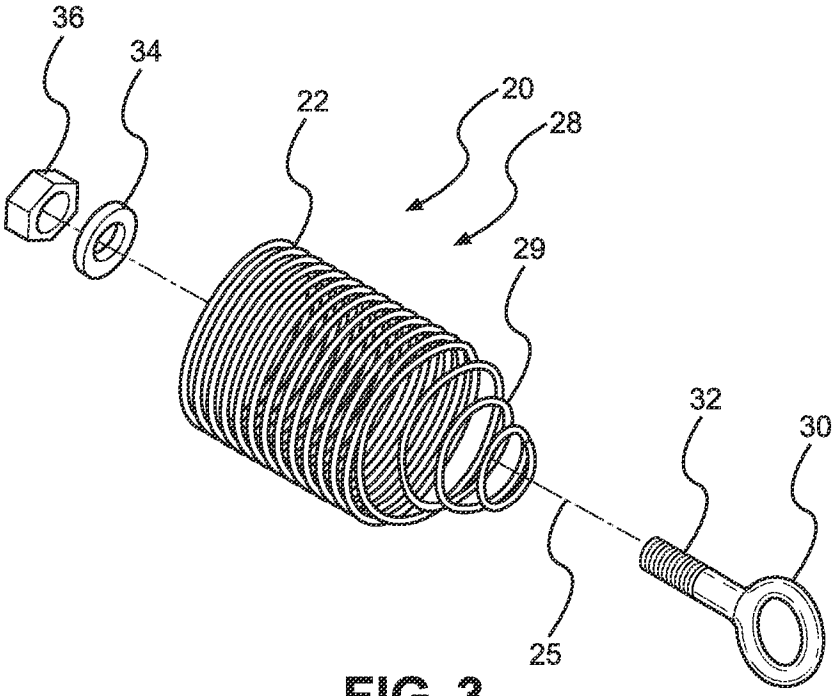
FIG. 3 is an enlarged perspective view of a second end of a coil spring of the shrouded spring assembly of FIG. 1 in accordance with an example embodiment.

Similarly, in some embodiments, the second attachment member 30 may be configured as an eye member 31 that is coupled to the second end 28 of the cylindrical body 22 opposite the first end 26. More specifically, in some embodiments, the eye member 31 may be configured as an eye bolt that is attached to the second end 28. For example, FIG. 3 is an enlarged perspective view of the second end 28 of the coil spring 20 in accordance with an example embodiment. In some embodiments, the second end 28 includes a conical end portion 29 that converges to a smaller diameter than the cylindrical body 22. A threaded shaft 32 of the eye member 31 is inserted through the conical end portion 29, and through a washer 34, and is threadedly engaged with a nut 36, securing the eye member 31 to the second end 28 of the coil spring 22.

It will be appreciated that the coil spring 20 is not necessarily limited to the particular embodiments shown in FIGS. 1-3. For example, in some embodiments, both the first and second attachment members 24, 30 may be configured to be substantially similar or identical attachment members. More specifically, in some embodiments, both the first and second attachment members 24, 30 may be configured as hook members (e.g. hook member 23). In other embodiments, both the first and second attachment members 24, 30 may be configured as eye members (e.g. eye member 31). And in some embodiments, the end portions may be reversed, so that the eye member 31 is proximate the first end 26 of the coil spring 20, and the hook member 23 is proximate the second end 28 of the coil spring 20. And in further embodiments, both the first and second attachment members 24, 30 may be configured as other suitable types of attachment members. Therefore, a variety of alternate embodiments of the coil spring 20 may be readily conceived and are within the scope of the present disclosure.

D. Shroud

Referring again to FIGS. 1 and 2, the shrouded spring assembly 10 further includes a shroud 40. In some embodiments, the shroud 40 includes a sleeve portion 42 that encapsulates the cylindrical body 22 of the coil spring 20. In some embodiments, the sleeve portion 42 is configured to expand in a lengthwise direction along the longitudinal axis 25 as the coil spring 20 is stretched by an exercising force, and further configured to contract again as the exercising force is relieved and the coil spring 20 returns to its relaxed length L1.

More specifically, in some embodiments, the sleeve portion 42 may be an expandable portion that is made from a suitably flexible or stretchable material that enables the sleeve portion 42 to expand in a lengthwise direction along the longitudinal axis 25 as the coil spring 20 is stretched by an exercising force, and then to contract again as the exercising force is relieved and the coil spring 20 returns to its relaxed length L1 (FIG. 2). In some embodiments, the sleeve portion 42 of the shroud 40 may be formed of a flexible or stretchable material that includes a durable polymeric or other synthetic material. As shown in FIGS. 1-2, in some embodiments, the sleeve portion 42 may be fashioned to include a plurality of pleats (or folds) 44 that enables the sleeve portion 42 to expand and contract in a lengthwise direction along the longitudinal axis 25 with the expansion and contraction of the cylindrical body 22 of the coil spring 20. Accordingly, in some embodiments, the sleeve portion 42 is expandable and retractable along the longitudinal axis 25 to accommodate stretching and retracting of the cylindrical body 22 responsive to opposing forces applied to the first and second attachment members 24, 30 of the coil spring 20 along the longitudinal axis 25.

In addition, in some embodiments, the shroud 40 further includes a first end portion 46 proximate the first end 26 of the cylindrical body 22, and a second end portion 54 proximate the second end 28 of the cylindrical body 22. The first and second end portions 46, 54 are coupled to the sleeve portion 42 and are configured to substantially encapsulate first and second ends 26, 28 of the cylindrical body 22 while permitting engagement of the first and second attachment members 24, 30 with other external structures or devices, as described more fully below.

More specifically, in some embodiments, the first end portion 46 of the shroud 40 may be configured as a guard end 47 that is coupled to the sleeve portion 42 and that is configured to substantially encapsulate the first attachment member 24 projecting from the first end 26 of the cylindrical body 22. As best shown in FIG. 2, in some embodiments, wherein the first attachment member 24 of the coil spring 20 is configured as a hook member 23, the guard end 47 of the shroud 40 may include a compartment 48 that substantially surrounds the hook member 23. In some embodiments, the compartment 48 of the guard end 47 may be a flattened compartment that surrounds and substantially encapsulates the hook member 23 on four sides. A pair of apertures 50 may be formed through opposing sides of the guard end 47 (e.g. opposing sides of the compartment 48) proximate the hook member 23 to enable an external device, such as a coupling ring 52 or other suitable coupling device (e.g. a carabiner, an openable chain link, etc.), to be engaged through the apertures 50 and into engagement with the hook member 23.

Similarly, in some embodiments, the second end portion 54 of the shroud 40 may be configured as a closeable end 55 that is coupled to the sleeve portion 42 and that is configured to be selectively opened and closed over the second end 28 of the coil spring 20 while leaving the second attachment member 30 exposed outside the shroud 40. For example, in some embodiments, the closeable end 55 may include one or more flaps 56 extending outwardly from the sleeve portion 42, the one or more flaps 56 being configured to be extended through the second attachment member 30 and secured in position by a securing device 58. For example, in some embodiments, the closeable end 55 includes at least one flap 56 proximate to the eye member 31 that may be folded through the eye member 31 and secured in position by the securing device 58. In the embodiment shown in FIG. 1, the securing device 58 is a snap assembly (having a stud mounted on the flap 56 and a socket mounted on the sleeve portion 42 or on another flap 56 in an overlapping fashion), however, in other embodiments, any other suitable types of securing devices may be used, including hook and loop fasteners (e.g. Velcro™), hook and eye fasteners, cinches, or any other suitable securing devices. Because the closeable end 55 of the shroud 40 is selectively openable and closeable, the shroud 40 may be easily removed from the coil spring 20 for cleaning or replacement.

It will be appreciated that the shroud 40 is not necessarily limited to the particular embodiments shown in FIGS. 1-2. For example, in some embodiments, both the first and second end portions 46, 54 may be configured to be substantially similar or identical attachment members. More specifically, in some embodiments, both the first and second end portions 46, 54 may be closeable end portions (e.g. closeable end 55) (see FIG. 1), while in other embodiments, both the first and second end portions 46, 54 may be guard end portions (e.g. guard end 47). In some embodiments, the first end portion 46 may be a guard end 47 and the second end portion 54 may be a closeable end 55 (e.g. FIG. 2). And in some embodiments, the end portions may be reversed, so that the closeable end 55 is proximate the first end 26 of the coil spring 20, and the guard end 47 is proximate the second end 28 of the coil spring 20 (e.g. such that the compartment 48 of the guard end 47 substantially encapsulates the eye member 31). And in further embodiments, both the first and second end portions 46, 54 may be configured as other suitable types of end portions. Therefore, a variety of alternate embodiments of the shroud 40 may be readily conceived and are within the scope of the present disclosure.

Accordingly, in some embodiments, a shrouded spring assembly 10 includes a coil spring 20 having a cylindrical body 22 that extends along a longitudinal axis 25, the coil spring 20 including a first attachment member 24 (e.g. hook member 23) coupled to a first end 26 of the cylindrical body 22 and projecting outwardly from the first end 26 at least partially along the longitudinal axis 25, and a second attachment member 30 (e.g. eye member 31) coupled to a second end 28 of the cylindrical body 22 opposite the first end 26 and projecting outwardly from the second end 28 at least partially along the longitudinal axis 25; and a shroud 40 having a sleeve portion 42 that encapsulates at least the cylindrical body 22 of the coil spring 20, the sleeve portion 42 including first and second end portions 46, 54 (e.g. guard end 47 and closeable end 55) proximate the first and second attachment members 24, 30, respectively, each of the first and second end portions 46, 54 being configured to enable the first and second attachment members 24, 30 to be operatively couplable to one or more external devices (e.g. coupling ring 52), the sleeve portion 42 being expandable and retractable along the longitudinal axis 25 to accommodate stretching and retracting of the cylindrical body 22 responsive to opposing forces applied to the first and second attachment members 24, 30 along the longitudinal axis 25.

In some embodiments, the cylindrical body 22 of the coil spring 20 is stretchable along the longitudinal axis 25 responsive to opposing forces applied to the first attachment member 24 and the second attachment member 30 along the longitudinal axis 25, and retractable to a resting length L1 in response to removal of the opposing forces. In some embodiments, the sleeve portion 42 is made from a suitably flexible or stretchable material that enables the sleeve portion 42 to expand in a lengthwise direction along the longitudinal axis 25 as the coil spring 20 is stretched by an exercising force, and then to contract again as the exercising force is relieved. And in some embodiments, the sleeve portion 42 includes a plurality of pleats 44 that enables the sleeve portion 42 to expand and contract in a lengthwise direction along the longitudinal axis 25 with the expansion and contraction of the cylindrical body 22 of the coil spring 20.

In some embodiments, at least one of the first or second attachment members 24, 30 of the coil spring 20 comprises a hook member 23 that projects at least partially along the longitudinal axis 25. Similarly, in some embodiments, at least one of the first or second attachment members 24, 30 comprises an eye member 31 that projects at least partially along the longitudinal axis 25. And in some embodiments, at least one of the first or second end portions 46, 54 of the shroud 40 comprises a guard end 47 including a substantially enclosed compartment 48 having a pair of apertures 50 disposed through opposing sidewalls thereof. In some embodiments, at least one of the first or second end portions 46, 54 of the shroud 40 comprises a closeable end 55 including at least one flap 56 configured to be extended through at least one of the first or second attachment members and secured in position by a securing device 58.

In some embodiments, the first attachment member 24 of the coil spring 20 comprises a hook member 23 that projects at least partially along the longitudinal axis 25, and wherein the first end portion 46 of the shroud 40 comprises a guard end 47 including a compartment 48 that substantially encapsulates the hook member 23, the compartment 48 having a pair of apertures 50 disposed through opposing sidewalls thereof to enable operative engagement of the hook member 23 with an external device 52. Similarly, in some embodiments, the shrouded spring assembly 10 further comprises a coupling ring 52 operatively engaged through the pair of apertures 50 of the guard end 47 and operatively engaged with the hook member 23.

Embodiments of shrouded spring assemblies in accordance with the present disclosure may provide considerable advantages over the prior art. For example, in some embodiments, shrouded spring assemblies are easily transportable to any desired location. Moreover, in some embodiments, the shroud may advantageously prevent foreign objects from becoming pinched or caught in the coil spring as it expands and contracts. And in some embodiments, because the shroud may be easily removed from the coil spring, the shroud may be easily cleaned or replaced as it becomes worn due to extended use.

E. Operation Example Embodiments

It will be appreciated that shrouded spring assemblies in accordance with the present disclosure may be used as a stand-alone exercise device, or may be incorporated as a component into a larger, more complex exercise machine. In this section, techniques for using shrouded spring assemblies as stand-alone exercise devices will be described. Exercise machines that incorporate shrouded spring assemblies will then be described in the following sections below.

Figure 4:
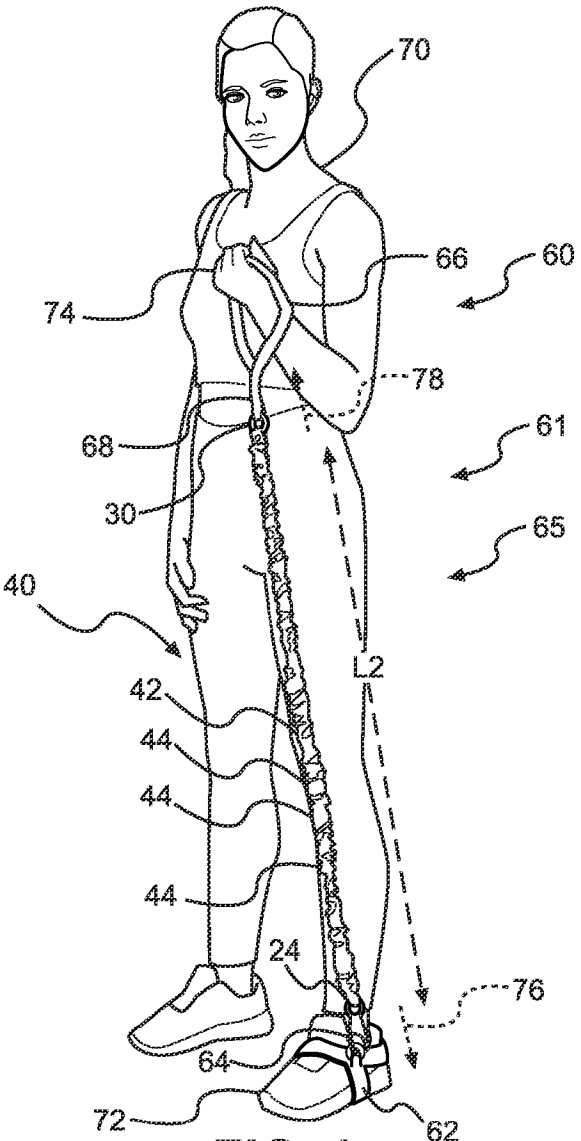
FIG. 4 is a perspective view of an exercise apparatus that includes a shrouded spring assembly in a first use scenario in accordance with an example embodiment.
Figure 5:
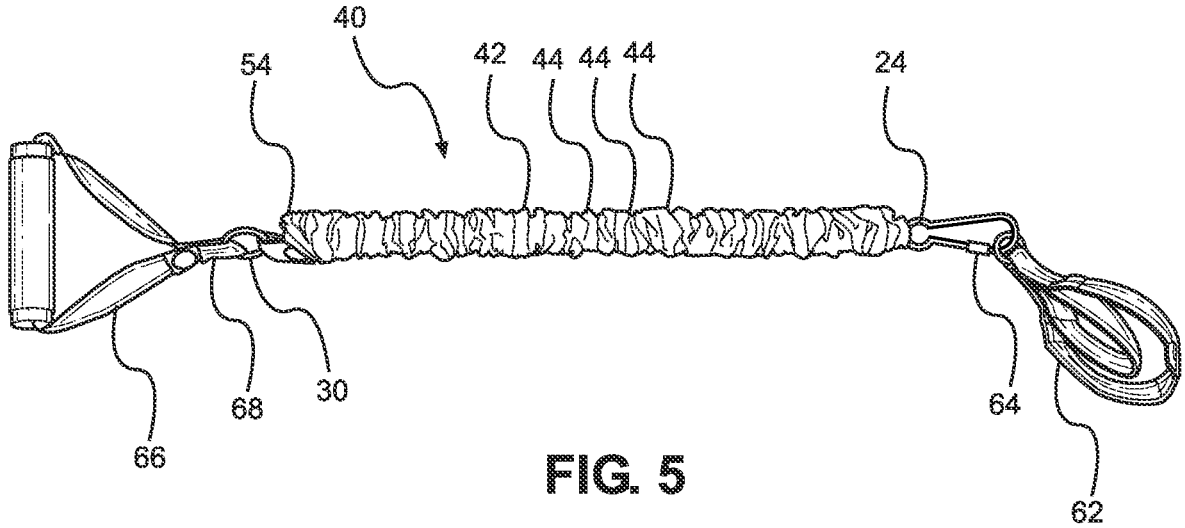
FIG. 5 is an enlarged, elevational view of the exercise apparatus of FIG. 4 in accordance with an example embodiment.

In use, shrouded spring assemblies in accordance with the present disclosure may be coupled to a wide variety of interface devices and may be used in a wide variety of use scenarios. For example, FIG. 4 is a perspective view of an exercise apparatus 60 in a first use scenario 65 in accordance with an example embodiment. FIG. 5 is an enlarged, elevational view of the exercise apparatus 60 of FIG. 4. In some embodiments, the exercise apparatus 60 includes a shrouded spring assembly 61 having a coil spring 20 substantially encapsulated by a shroud 40 as described above with respect to FIGS. 1-3. More specifically, in some embodiments, the shroud 40 of the shrouded spring assembly 61 includes closeable ends 55 (e.g. see FIG. 1) at each end of the sleeve portion 42. In some embodiments, as shown in FIGS. 4-5, the exercise apparatus 60 further includes a first user interface 62 coupled by a first coupling device 64 to the first attachment member 24 of the coil spring 20, and a second user interface 66 coupled by a second coupling device 68 to the second attachment member 30 of the coil spring 20. The first and second coupling devices 64, 68 may, for example, be carabiners, openable links, or any other suitable coupling devices.

In operation, the user 70 engages a first body portion 72 (e.g. a foot) with the first user interface 62 and a second body portion 74 (e.g. a hand) with the second user interface 66. The user 70 may then apply first and second exercising forces 76, 78 (e.g. downward and upward) in an opposing fashion on the user interfaces 62, 66 along the longitudinal axis 25 of the coil spring 20, stretching the coil spring 20 (and the shroud 40) into a stretched length L2 and thereby exercising the desired muscles against the tension force of the coil spring 20. The user 70 may then relax or remove the first and second exercising forces 76, 78, allowing the coil spring 20 (and the shroud 40) to become less stretched and return as least partially toward the fully relaxed length L1. The user 70 may then re-apply the first and second exercising forces 76, 78, re-stretching the coil spring 20 (and the shroud 40) to the stretched length L2. These operations may then be repeated to achieve a desired exercising effect on the user's body. In some embodiments, the user 70 may only partially reduce the first and second exercising forces 76, 78, allowing the coil spring 20 (and the shroud 40) to return to a less stretched length, but may not return entirely to the relaxed length L1 until a desired number of exercising repetitions have been completed. These operations may be repeated indefinitely until the user 70 has achieved a desired level of exercise.

Figure 6:
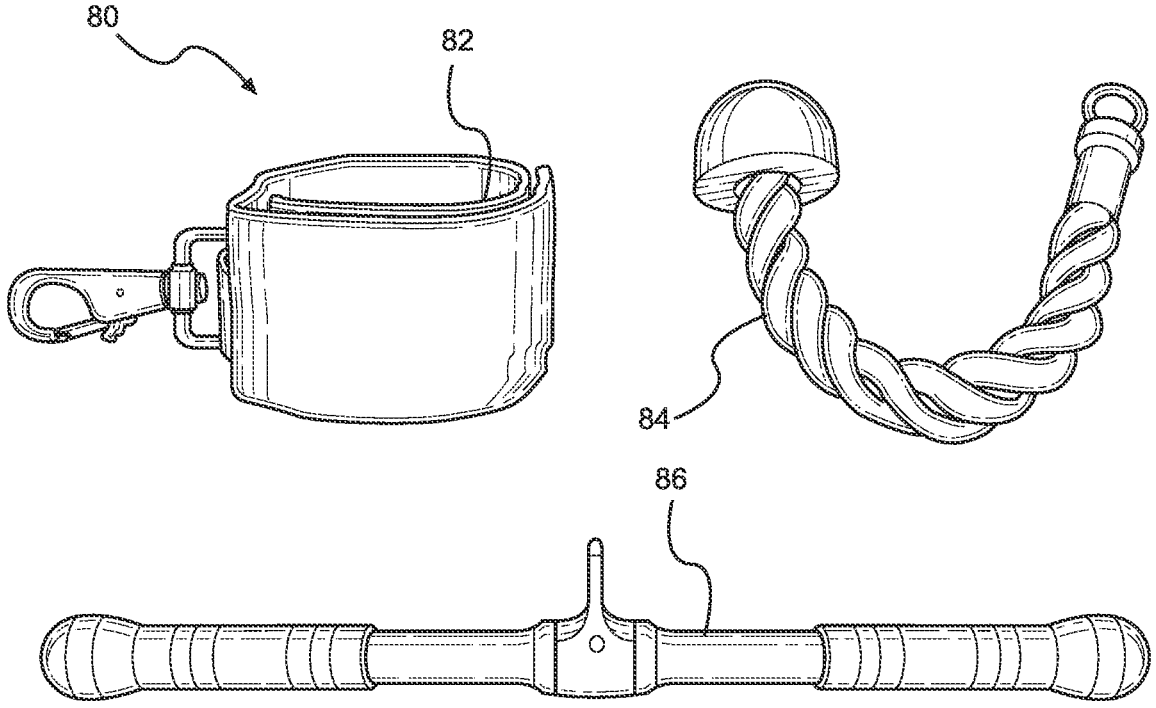
FIG. 6 shows a plurality of user interfaces that may be used with shrouded spring assemblies in accordance with further example embodiments.

It will be appreciated, however, that a variety of suitable user interfaces may be employed in combination with shrouded spring assemblies in accordance with the present disclosure. In the embodiment shown in FIGS. 4 and 5, the first user interface 62 is configured as a foot harness, and the second user interface 66 is configured as a handle. FIG. 6, however, shows a plurality of user interfaces 80 that may be used with shrouded spring assemblies in accordance with further example embodiments. In some embodiments, the shrouded spring assembly 60 may include an ankle cuff 82 for coupling with an ankle of the user 70, or a rope handle 84 to be grasped by the user 70, or a bar handle 86 that may be held by the hands of the user 70. Of course, the plurality of user interfaces 80 shown in FIG. 6 is merely representative of a wide variety of user interfaces that may be used with shrouded spring assemblies in accordance with the present disclosure.

Figure 7:
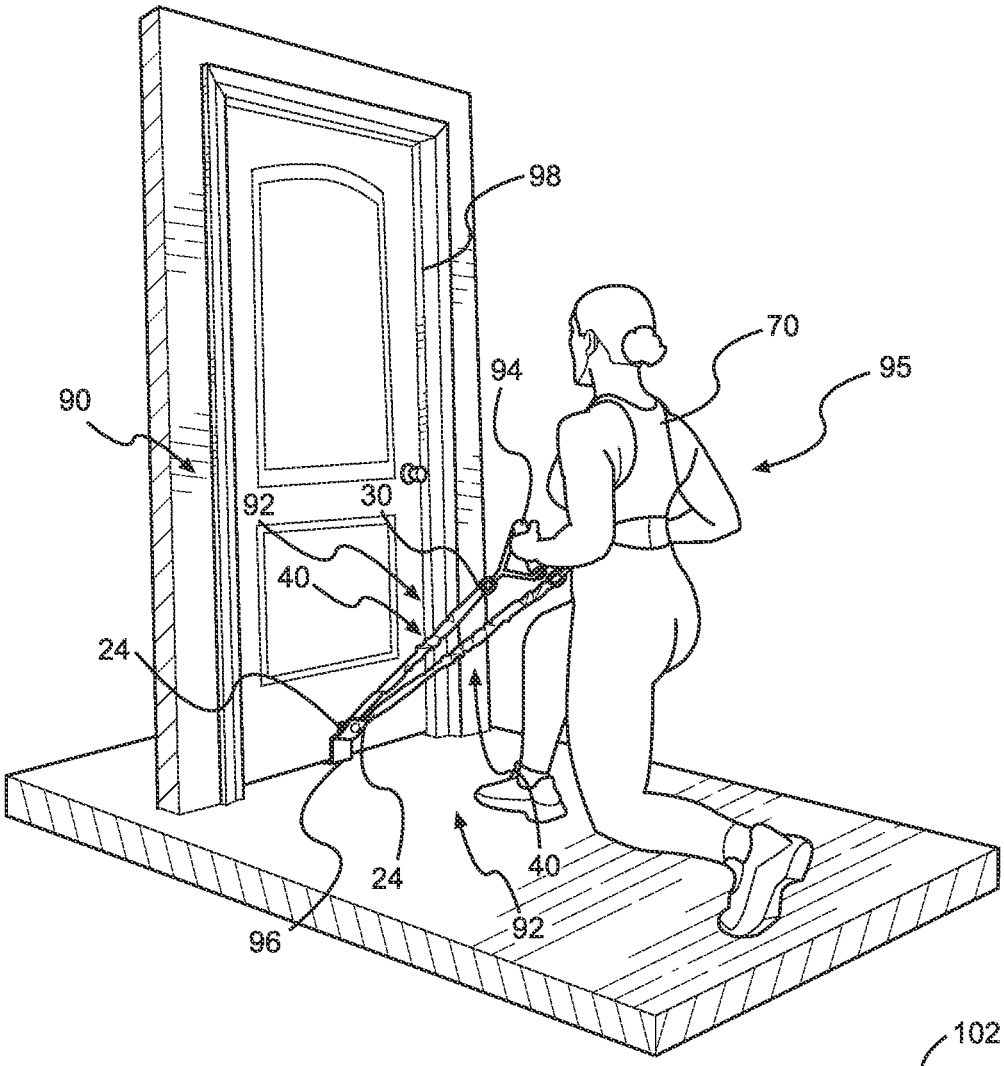
FIG. 7 is a perspective view of an exercise apparatus that includes a pair of shrouded spring assemblies in a second use scenario in accordance with an example embodiment.

FIG. 7 is a perspective view of an exercise apparatus 90 in a second use scenario in accordance with another example embodiment. As shown in FIG. 7, in some embodiments, the exercise apparatus 90 includes two shrouded spring assemblies 92. Each shrouded spring assembly 92 includes a coil spring 20 substantially encapsulated by a shroud 40 as described above with respect to FIGS. 1-3. In some embodiments, the first attachment member 24 of each shrouded spring assembly 92 is coupled to a mounting structure 96 that couples to a door 98, while the second attachment member 30 is coupled to a user interface 94 (e.g. handle) (one visible). For example, in some embodiments, the mounting structure 96 may be coupled to a bottom portion of the door 98 (FIG. 7), however, in further embodiments, the mounting structure 96 may be coupled to a top portion, side portion, or any other portion of the door 98. More specifically, in some particular embodiments, the mounting structure 96 may be of the type disclosed in U.S. Pat. No. 11,452,904 B1 issued to Lagree et al.

In operation, the user 70 grasps the user interfaces 94 (one visible) with her hands and applies an exercising force along the longitudinal axis 25 of each coil spring 20 of the shrouded spring assemblies 92, stretching each coil spring 20 (and shroud 40) into a stretched length L2 (e.g. FIG. 4) and thereby exercising the desired muscles against the tension forces of the coil springs 20. The user 70 may then relax or remove the exercising forces, allowing the coil spring 20 (and the shroud 40) of each shrouded spring assembly 92 to become less stretched and return as least partially toward the fully relaxed length L1. The user 70 may then re-apply the exercising forces, re-stretching the coil springs 20 (and the shrouds 40) to the stretched length L2. These operations may then be repeated to achieve a desired exercising effect on the user's body. In some embodiments, the user 70 may only partially reduce the exercising forces, allowing the coil springs 20 (and the shrouds 40) of the shrouded spring assemblies 92 to return to a less stretched length, but may not return entirely to the relaxed length L1 until a desired number of exercising repetitions have been completed. These operations may be repeated indefinitely until the user 70 has achieved a desired level of exercise.

Accordingly, in some embodiments, an exercise apparatus 60, 90 may comprise a shrouded spring assembly 61, 92 that includes a coil spring 20 having a cylindrical body 22 that extends along a longitudinal axis 25, the coil spring 20 including a first attachment member 24 coupled to a first end 26 of the cylindrical body 22 and projecting outwardly from the first end 26 at least partially along the longitudinal axis 25, and a second attachment member 30 coupled to a second end 28 of the cylindrical body 22 opposite the first end 26 and projecting outwardly from the second end 28 at least partially along the longitudinal axis 25; and a shroud 40 having a sleeve portion 42 that encapsulates at least the cylindrical body 22 of the coil spring 20, the sleeve portion 42 including first and second end portions 46, 54 proximate the first and second attachment members 24, 30, respectively, at least one of the first and second end portions 46, 54 being configured to enable a corresponding at least one of the first and second attachment members 24, 30 to be operatively coupled to a corresponding at least one user interface 62, 66, the sleeve portion 42 being expandable and retractable along the longitudinal axis 25 to accommodate stretching and retracting of the cylindrical body 22 responsive to at least one exercising force applied to at least one of the first and second attachment members 24, 30 along the longitudinal axis 25; and at least one user interface 62, 66 operatively coupled to at least one of the first and second attachment members 24, 30, the at least one user interface 62, 66 configured to engage with a user 70 for applying the at least one exercising force to the at least one of the first and second attachment members 24, 30 along the longitudinal axis 25.

In some embodiments, the sleeve portion 42 is made from a material that is at least one of flexible or stretchable that enables the sleeve portion 42 to expand in a lengthwise direction along the longitudinal axis 25 as the cylindrical body 22 is stretched by the at least one exercising force, and then to contract again as the at least one exercising force is relieved. Moreover, in some embodiments, the sleeve portion 42 includes a plurality of pleats 44 that enables the sleeve portion 42 to expand and contract in a lengthwise direction along the longitudinal axis 25 with the expansion and contraction of the cylindrical body 22. In further embodiments, the at least one user interface 62, 66 comprises at least one of a handle, a foot harness, an ankle cuff, a rope handle, or a bar handle. And in some embodiments, the at least one user interface 62, 66 comprises a handle coupled to the second attachment member 30, the exercise apparatus further comprising a mounting structure 96 coupled to the first attachment member 24, the mounting structure 96 configured to attach to an external structure 98.

F. Exercise Machine Embodiments that Include Shrouded Spring Assemblies

Figure 8:
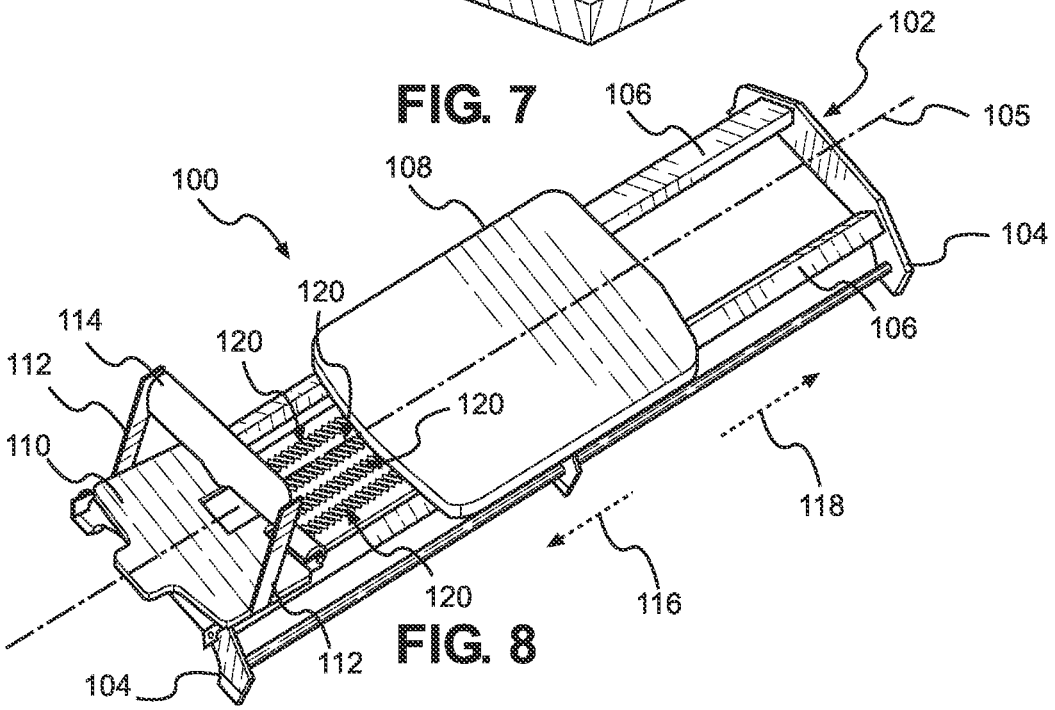
FIG. 8 is a perspective view of an exercise machine that includes a plurality of shrouded spring assemblies in accordance with an example embodiment.

Shrouded spring assemblies in accordance with the present disclosure may also be incorporated into a wide variety of exercise machines and may be used in a wide variety of use scenarios. For example, FIG. 8 is a perspective view of an exercise machine 100 that includes a plurality of shrouded spring assemblies 120 in accordance with an example embodiment. More specifically, in some embodiments, the exercise machine 100 may include a support frame 102 having a plurality of supports 104 that support a pair of rails 106. In some embodiments, the rails 106 may be parallel and may extend lengthwise along a longitudinal axis 105 of the exercise machine 100. A slidable carriage 108 may slide along the rails 106 in response to a user's movements. For example, a user may perform exercises by moving the slidable carriage 108 along the rails 106 in forward and rearward directions 116, 118 substantially along the longitudinal axis 105 of the exercise machine 100. In some embodiments, the support frame 102 of the exercise machine 100 further includes a fixed end 110 having a pair of raised uprights 112 that support a push handle 114.

A resistance force may be generated by attaching or adjusting one or more shrouded spring assemblies 120 between the slidable carriage 108 and the fixed end 110 of the lower structure 102. In some embodiments, each of the shrouded spring assemblies 120 includes a coil spring 20 substantially encapsulated by a shroud 40 as described above with respect to FIGS. 1-3. In some embodiments, the first attachment member 24 of each shrouded spring assembly 120 may be coupled to the fixed end 110 of the lower support structure 102, while the second attachment member 30 of each shrouded spring assembly 120 is coupled to the slidable carriage 108. Of course, in alternate embodiments, the orientations of one or more of the shrouded spring assemblies 120 may be reversed such that the second attachment member 30 is coupled to the fixed end 110 and the first attachment member 24 is coupled to the slidable carriage 108.

As shown in FIG. 8, in some embodiments, there may be four shrouded spring assemblies 120 coupled between the between the slidable carriage 108 and the fixed end 110, however, in other embodiments, any suitable number of shrouded spring assemblies 120 may be employed. For example, in some alternate embodiments, an exercise machine may include a fewer number of shrouded spring assemblies 120 (e.g. 1, 2, 3) or a greater number of shrouded spring assemblies 120 (e.g. 5, 6, etc.).

Figure 9:
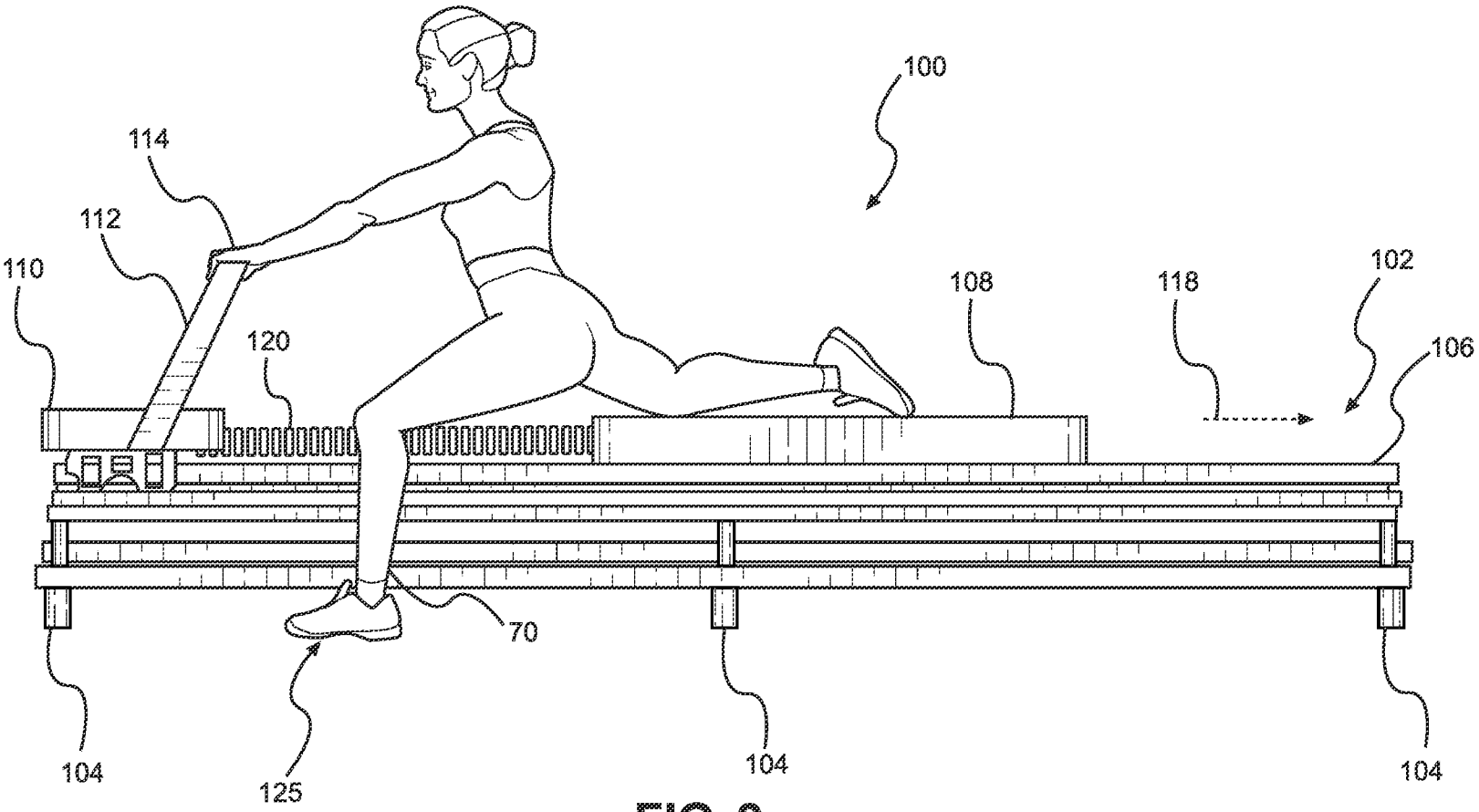
FIG. 9 is a side elevational view of the exercise machine of FIG. 8 in a third use scenario in accordance with an example embodiment.

FIG. 9 is a side elevational view of the exercise machine 100 of FIG. 8 in a third use scenario 125 in accordance with an example embodiment. In operation, the user 70 may work against the resistance of the shrouded spring assemblies 120 by applying a workload force that exceeds the spring resistance force. The workload force may be applied in the rearward direction 118 to the slidable carriage 108, such that the slidable carriage 108 slides along the rails 106 away from the fixed end 110, stretching the coil springs 20 and the shrouds 40 of the shrouded spring assemblies 120.

More specifically, the user 70 assumes an exercising position on the slidable carriage 108, grasps the push handle 114 with her hands, and applies an exercising force to the slidable carriage 108 in the rearward direction 118 and along the longitudinal axis 25 of each coil spring 20 of the shrouded spring assemblies 120, moving the slidable carriage 108 in the rearward direction 118 and stretching each coil spring 20 (and shroud 40) into a stretched length L2, thereby exercising the desired muscles against the tension forces of the coil springs 20. The user 70 may then relax or remove the exercising force, allowing the slidable carriage 108 to move in the forward direction 116 and allowing each coil spring 20 (and shroud 40) of each shrouded spring assembly 120 to become less stretched and return as least partially toward the relaxed length L1. The user 70 may then re-apply the exercising forces, moving the slidable carriage 108 in the rearward direction 118 and re-stretching the coil springs 20 (and the shrouds 40) to the stretched length L2. These operations may then be repeated to achieve a desired exercising effect on the user's body. In some embodiments, the user 70 may only partially reduce the exercising forces, allowing the coil springs 20 (and the shrouds 40) of the shrouded spring assemblies 120 to return to a less stretched length, but may not return entirely to the relaxed length L1 until a desired number of exercising repetitions have been completed. These operations may be repeated indefinitely until the user 70 has achieved a desired level of exercise.

Accordingly, in some embodiments, an exercise machine 100 includes: a support frame 102 having a fixed portion (e.g. fixed end 110) and at least one rail 106; a slidable member (e.g. slidable carriage 108) slidably coupled to the at least one rail 106; and at least one shrouded spring assembly 120 coupled between the fixed portion 110 of the support frame 102 and the slidable member 108. In some embodiments, the at least one shrouded spring assembly 120 includes: a coil spring 20 having a cylindrical body 22 including a first attachment member 24 coupled to a first end 26 of the cylindrical body 22 and projecting outwardly from the first end 26, and a second attachment member 30 coupled to a second end 28 of the cylindrical body 22 opposite the first end 26 and projecting outwardly from the second end 28; and a shroud 40 having a sleeve portion 42 that substantially encapsulates at least the cylindrical body 22 of the coil spring 20, the sleeve portion 42 including first and second end portions 46, 54 proximate the first and second attachment members 24, 30, respectively, each of the first and second end portions 46, 54 being configured to enable the first and second attachment members 24, 30 to be operatively couplable to one or more external devices (e.g. fixed end 110, slidable carriage 108), the sleeve portion 42 being expandable and retractable along a longitudinal axis 25 of the coil spring 20 to accommodate stretching and retracting of the cylindrical body 22 responsive to opposing forces applied to the first and second attachment members 24, 30 along the longitudinal axis 25 as the slidable member 108 is moved on the at least one rail 106.

In some embodiments, the sleeve portion 42 is made from a material that is at least one of flexible or stretchable that enables the sleeve portion 42 to expand in a lengthwise direction along the longitudinal axis 25 as the cylindrical body 22 is stretched by the at least one exercising force, and then to contract again as the at least one exercising force is relieved. In further embodiments, the sleeve portion 42 includes a plurality of pleats 44 that enables the sleeve portion 42 to expand and contract in a lengthwise direction along the longitudinal axis 25 with the expansion and contraction of the cylindrical body 22. And in some embodiments, at least one of the first or second end portions 46, 55 of the shroud 40 comprises a closeable end 55 including at least one flap 56 configured to be extended through at least one of the first or second attachment members 24, 30 and secured in position by a securing device 58.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. A shrouded spring assembly for musculoskeletal exercise training, comprising:

a coil spring having a cylindrical body including a first attachment member coupled to a first end of the cylindrical body and projecting outwardly from the first end, and a second attachment member coupled to a second end of the cylindrical body opposite the first end and projecting outwardly from the second end; and a shroud having a sleeve portion that substantially encapsulates the cylindrical body of the coil spring, the sleeve portion including first and second end portions proximate to the first and second attachment members, respectively, each of the first and second end portions being configured to enable the first and second attachment members to be operatively couplable to one or more external devices, the sleeve portion being expandable and retractable along a longitudinal axis of the coil spring to accommodate stretching and retracting of the cylindrical body responsive to opposing forces applied to the first and second attachment members along the longitudinal axis;

wherein at least one of the first or second end portions of the shroud comprises a guard end including a substantially enclosed compartment having a pair of apertures disposed through opposing sidewalls thereof, the pair of apertures being non-slotted and respectively circumferentially continuous.

2. The shrouded spring assembly of claim 1, wherein the cylindrical body is stretchable along the longitudinal axis responsive to the opposing forces applied to the first attachment member and the second attachment member along the longitudinal axis, and retractable to a resting length in response to removal of the opposing forces.

3. The shrouded spring assembly of claim 1, wherein the sleeve portion is made from a material that is at least one of flexible or stretchable that enables the sleeve portion to expand in a lengthwise direction along the longitudinal axis as the coil spring is stretched by the opposing forces, and then to contract again as the opposing forces are relieved.

4. The shrouded spring assembly of claim 1, wherein the sleeve portion includes a plurality of pleats that enables the sleeve portion to expand and contract in a lengthwise direction along the longitudinal axis with the expansion and contraction of the cylindrical body.

5. The shrouded spring assembly of claim 1, wherein at least one of the first or second attachment members comprises a hook member that projects at least partially along the longitudinal axis.

6. The shrouded spring assembly of claim 1, wherein at least one of the first or second attachment members comprises an eye member that projects at least partially along the longitudinal axis.

7. The shrouded spring assembly of claim 1, wherein at least one of the first or second end portions of the shroud comprises a closeable end including at least one flap configured to be extended through at least one of the first or second attachment members and secured in position by a securing device.

8. The shrouded spring assembly of claim 1, wherein the first attachment member comprises a hook member that projects at least partially along the longitudinal axis, and wherein the first end portion of the shroud comprises the guard end including the compartment that substantially encapsulates the hook member, the compartment having the pair of apertures disposed through the opposing sidewalls thereof to enable operative engagement of the hook member with one of the one or more external devices.

9. The shrouded spring assembly of claim 8, further comprising a coupling device operatively engaged through the pair of apertures of the guard end and operatively engaged with the hook member.

10. The shrouded spring assembly of claim 1, further comprising a user interface operatively coupled to at least one of the first or second attachment members.

11. An exercise apparatus, comprising:

a shrouded spring assembly including:

a coil spring having a cylindrical body that extends along a longitudinal axis, the coil spring including a first attachment member coupled to a first end of the cylindrical body and projecting outwardly from the first end at least partially along the longitudinal axis, and a second attachment member coupled to a second end of the cylindrical body opposite the first end and projecting outwardly from the second end at least partially along the longitudinal axis; and a shroud having a sleeve portion that encapsulates the cylindrical body of the coil spring, the sleeve portion including first and second end portions proximate to the first and second attachment members, respectively, at least one of the first and second end portions being configured to enable a corresponding at least one of the first and second attachment members to be operatively coupled to a corresponding at least one user interface, the sleeve portion being expandable and retractable along the longitudinal axis to accommodate stretching and retracting of the cylindrical body responsive to at least one exercising force applied to at least one of the first and second attachment members along the longitudinal axis;

wherein at least one of the first or second end portions of the shroud comprises a guard end including a substantially enclosed compartment having a pair of apertures disposed through opposing sidewalls thereof, the pair of apertures being non-slotted and respectively circumferentially continuous; and the at least one user interface operatively coupled to at least one of the first and second attachment members, the at least one user interface configured to engage with a user for applying the at least one exercising force to the at least one of the first and second attachment members along the longitudinal axis.

12. The exercise apparatus of claim 11, wherein the sleeve portion is made from a material that is at least one of flexible or stretchable that enables the sleeve portion to expand in a lengthwise direction along the longitudinal axis as the cylindrical body is stretched by the at least one exercising force, and then to contract again as the at least one exercising force is relieved.

13. The exercise apparatus of claim 11, wherein the sleeve portion includes a plurality of pleats that enables the sleeve portion to expand and contract in a lengthwise direction along the longitudinal axis with the expansion and contraction of the cylindrical body.

14. The exercise apparatus of claim 11, wherein the at least one user interface comprises at least one of a handle, a foot harness, an ankle cuff, a rope handle, or a bar handle.

15. The exercise apparatus of claim 11, wherein the at least one user interface comprises a handle coupled to the second attachment member, the exercise apparatus further comprising a mounting structure coupled to the first attachment member, the mounting structure configured to attach to an external structure.

* * * * *